US005183231A

United States Patent [19]

Pellerin

[11] Patent Number: 5,183,231

[45] Date of Patent: Feb. 2, 1993

[54] BOW POD OR HOLDER

[76] Inventor: James A. Pellerin, 2086 Anoka, Flint, Mich. 48532

[21] Appl. No.: 857,109

[22] Filed: Mar. 24, 1992

Related U.S. Application Data

[63] Continuation of Ser. No. 659,519, Feb. 21, 1991, abandoned.

[51] Int. Cl.[5] ..... A47F 7/00

[52] U.S. Cl. ..... 248/156; 248/309.1; 248/125; 211/13; 124/23.1

[58] Field of Search ..... 248/156, 122, 127, 309.1, 248/125; 211/13, 64; 124/23.1

[56] References Cited

U.S. PATENT DOCUMENTS

| | | | |
|---|---|---|---|
| 3,209,442 | 10/1965 | Watson | 124/23.1 X |
| 3,952,878 | 4/1976 | Gorham | 248/156 |
| 4,144,971 | 3/1979 | Balibrea | 248/156 X |
| 4,474,296 | 10/1984 | Hartman | 124/23.1 X |
| 4,896,854 | 1/1990 | St. Laurent | 248/156 |

*Primary Examiner*—Alvin C. Chin-Shue
*Attorney, Agent, or Firm*—James C. McLaughlin

[57] ABSTRACT

A bow pod for holding an archer's bow in an upright position comprises an upwardly open socket for holding the bow-end and a higher mounted, open sided groove or hook for holding the bowstring at a point below where the arrow is nocked. The socket may be attached to the ground with one or more bottom protruding spikes or may be attached to a structure such as a tree stand. The preferred embodiment utilizes a socket with a triangular cross section containing an essentially cylindrical cavity providing clearance for the end pulley or eccentric cam of a compound bow, and a single ground engaging spike. The groove of the preferred embodiment is roughly 260 mm above the socket, has its opening inclined away from the bow-limb, and is pivotally attached to the socket by a metal cylinder. The preferred embodiment also provides means for compactly stowing the parts of the device and means for attaching a string bobbin tracking device.

15 Claims, 7 Drawing Sheets

BOW POD OR HOLDER

This is a continuation of Ser. No. 07/659,519 filed Feb. 21, 1991, now abandoned.

TECHNICAL FIELD OF THE INVENTION

The technical field of the present invention is that of devices and methods for holding bows used in archery against forces such as those produced by gravity and wind. Such bows include compound bows. Specifically, the present invention concerns devices and methods to be used to hold bows such that they are able to be taken up by an archer with a minimum of effort and a minimum of bow movement. More specifically, the present invention concerns devices that inherently hold bows, especially compound bows, in an essentially vertical attitude, and that constrain the bowstring in so doing.

BACKGROUND INFORMATION

Archery, which has existed for some 30,000 years, was significantly advanced by the advent of the compound bow. The apparent advantages of the compound bow are somewhat tampered by its complex system of pulleys and strings, and its relatively large mass. The archer, whether on a target range or hunting in the field, wishes to be able to "park" his or her bow while resting or while otherwise engaged. Placing the bow on the ground often results in the pulleys or strings picking up debris and becoming fouled, with attendant unreliable bow action. Not only is it desirable to be able to "park" the bow without danger of fouling, but it is desirable to be able to leave an arrow nocked and ready for use, and (when hunting) to be able to take up the bow without the game noticing any bow movement. The hunting archer also desires to be able to "park" a bow whether using a ground mounted blind or a tree stand, and desires to be able to integrate the use of a string bobbin tracking device.

It is an inherent linguistic limitation that the same word is customarily used both for the entire apparatus used to discharge an arrow (the bow) and for the part of the apparatus exclusive of the strings and any pulleys (the bow). Context will often suggest which meaning is intended. It is the convention here to use "bow-limb" when the latter, more narrow, meaning is intended. Certain bows have an upper and a lower bow-limb separated by a riser. A riser may have an attachment point for a string bobbin tracking device. The outermost end, or ends, of a bow-limb shall be referred to as a "bow-end."

The desire to support a bow in a generally upright, fixed, and ready position has long been held. U.S. Pat. No. 3,441,241 is representative of bow holders for holding a conventional bow. This patent is particularly elegant in describing the desirable objects of a bow holder. This patent discloses a ground engaging spike and an attached means to engage both the front and back surface of a bow-limb of a conventional bow. The means disclosed are not suited to engaging both surfaces of a compound bow's bow-limb.

U.S. Pat. No. 4,331,311, 4,360,179, and 4,896,854 disclose a device appearing to be capable of holding a compound bow. Each of these patents have a lower means intended to support an end of the bow-limb and an upper means intended to support part of the bow-limb somewhat distant from the end of the bow-limb.

U.S. Pat. No. 4,331,311 discloses a lower means consisting of a pair of brackets (with a gap between them to give clearance to the compound bow's lower pulley or eccentric cam) each bracket having an inclined portion with an outside lip adapted to support the inside surface of the end of the compound bow's bow-limb. It appears that the inclined portions of the lower means also serve to resist the overturning moment of the whole bow and the lips serve to resist the whole bow's tendency to twist sideways. The same patent discloses an upper means that is essentially an inclined shelf for receiving the outside surface of the bow-limb somewhat distant from the end of the bow-limb.

U.S. Pat. No. 4,360,179 discloses a lower means that appears to be a bracket that is open at the top, and surrounds all except the inside surface of the end of the bow-limb with "suitable foamed elastomeric material." If used with a compound bow, the end pulley will bear down on the bracket with much of the weight of the bow. The upper means of this patent is a bracket that surrounds all except the inside surface of the bow-limb with the same "suitable foamed elastomeric material" at a place somewhat distant from the end of the bow-limb. It appears that the overturning moment of the whole bow, and the tendency of the whole bow to twist sideways, is likely to be resisted by friction forces directed into the "suitable foamed elastomeric material."

U.S. Pat. No. 4,896,854 discloses a preferred embodiment having a lower means that appears to be a cup shaped receptacle. If used with a compound bow, the end pulley will bear down on the receptacle with much of the weight of the bow. The upper means appears to be a U shaped bracket that surrounds all except the inside surface of the bow-limb at a place somewhat distant from the end of the bow-limb. The bow is cradled between the two means.

The above three noted patents support only a bow's bow-limb, require adjustment before they will hold a bow vertically, and are not such that bows are inherently held in an essentially vertical attitude. It also appears that the above noted patents only cradle a bow-limb with the result that a horizontal displacement (such as would be produced by the side force of a gust of wind) will tend to cause the bow to fall from the holder. Among the objects of the present invention is a holder, requiring essentially no adjustments, that inherently holds a bow in an essentially vertical attitude (detachably retaining the bowstring in so doing), and that is easily transported. Furthermore, it is an object of the present invention that the imposition of a side force to the held bow is met with a restoring force that tends to maintain the bow upright. Additional objects of this invention include avoidance of significant forces on any end pulley, provision for accommodating a string bobbin tracking device, and straightforward means for detachably attaching the invention to the earth or a structure.

SUMMARY OF THE INVENTION

The present bow pod invention is a device for holding an archer's bow that satisfies the aforementioned objects. It comprises a bow socket and a string holder operating cooperatively. The bow socket receives the end portion of the bow-limb(a compound bow in the preferred embodiment) such that the bow socket impedes motion of the received bow-end except upwardly. The bow socket is an upwardly open socket shaped to receive and confine a bow-end. A cavity is provided, within the socket, shaped to receive loosely an end-pulley. The string holder is positioned above the bow socket and (in the preferred embodiment) is pivotally attached to the bow socket. The string holder is a groove or hook that holds the bowstring of the bow, and the string holder is positioned such that the bow is held essentially vertically. The string holder is capable of retaining a bowstring, has an opening wider than a bowstring that faces away from the bow-limb, and surmounts the bow socket.

In the preferred embodiment, a spike protrudes from the bottom of the bow socket, means are provided to allow the nesting of the two parts of the invention to facilitate transportation, and means are provided for the attachment of a string bobbin tracking device.

DETAILED DESCRIPTION OF THE INVENTION AND ITS PREFERRED EMBODIMENT

Figure 5:
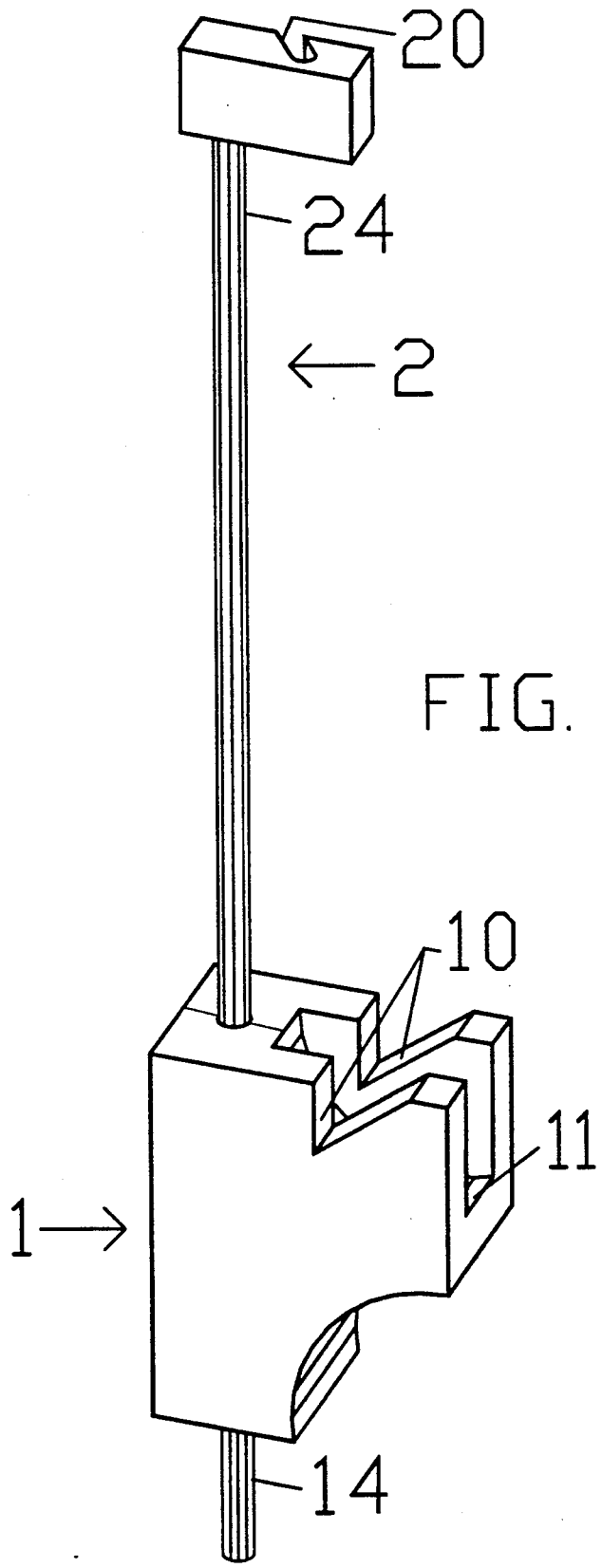
FIG. 5 is a perspective view of the string holder inserted into the bow socket when the ensemble is ready for use.
Figure 6:
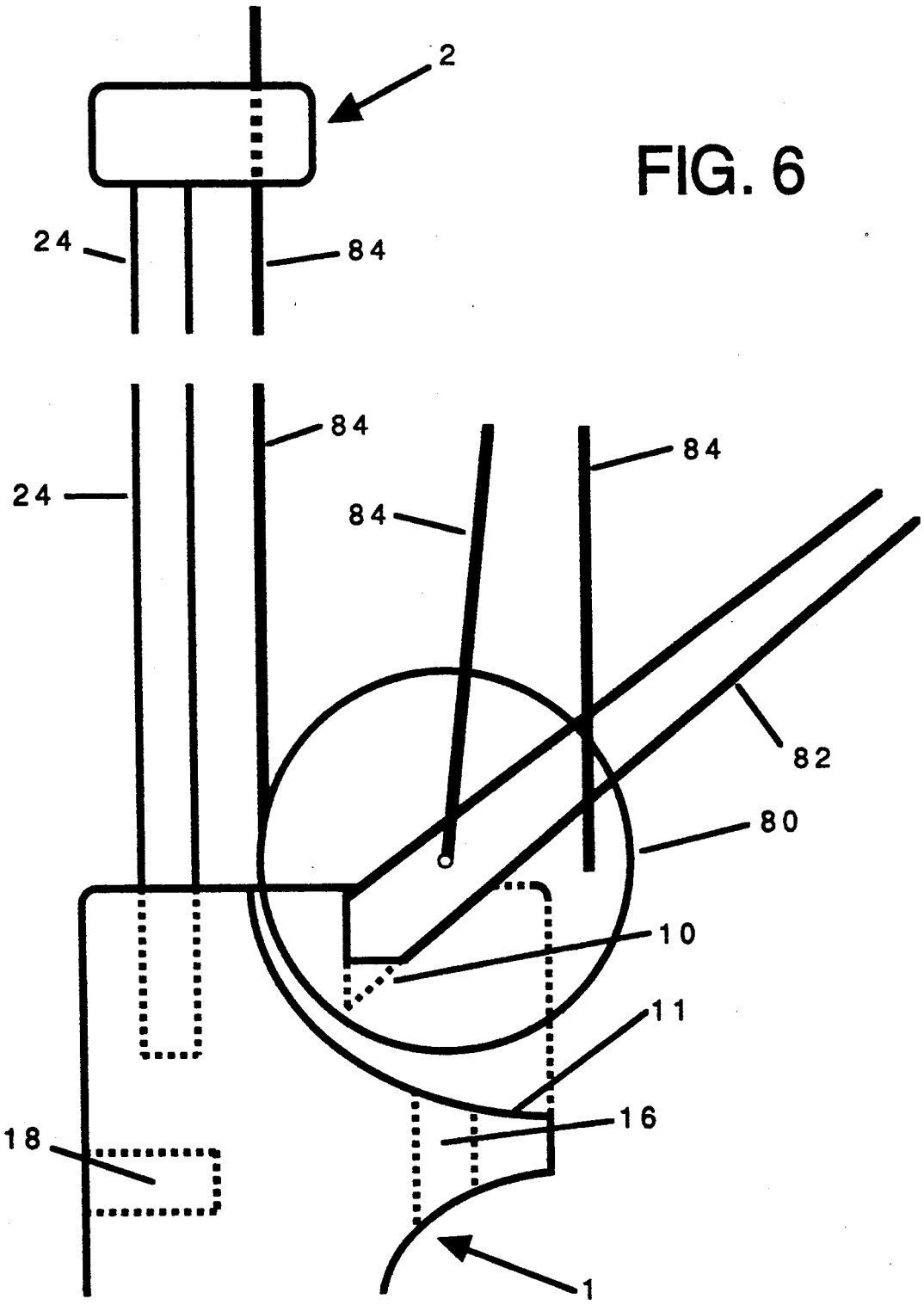
FIG. 6 is a sketch illustrating the engagement of the end of a compound bow with the bow socket and the engagement of a bowstring of a compound bow with the string holder when a compound bow is held.

The general nature of the preferred embodiment of the bow pod invention is illustrated on FIG. 5 and FIG. 6. The bow pod has two parts; the bow socket 1, which supports the lowest part of the bow-limb 82 of a compound bow 8, and the string holder 2, which supports bowstring 84. Compound bow 8 is not part of the invention and the invention is not limited to holding only compound bows.

Figure 1:
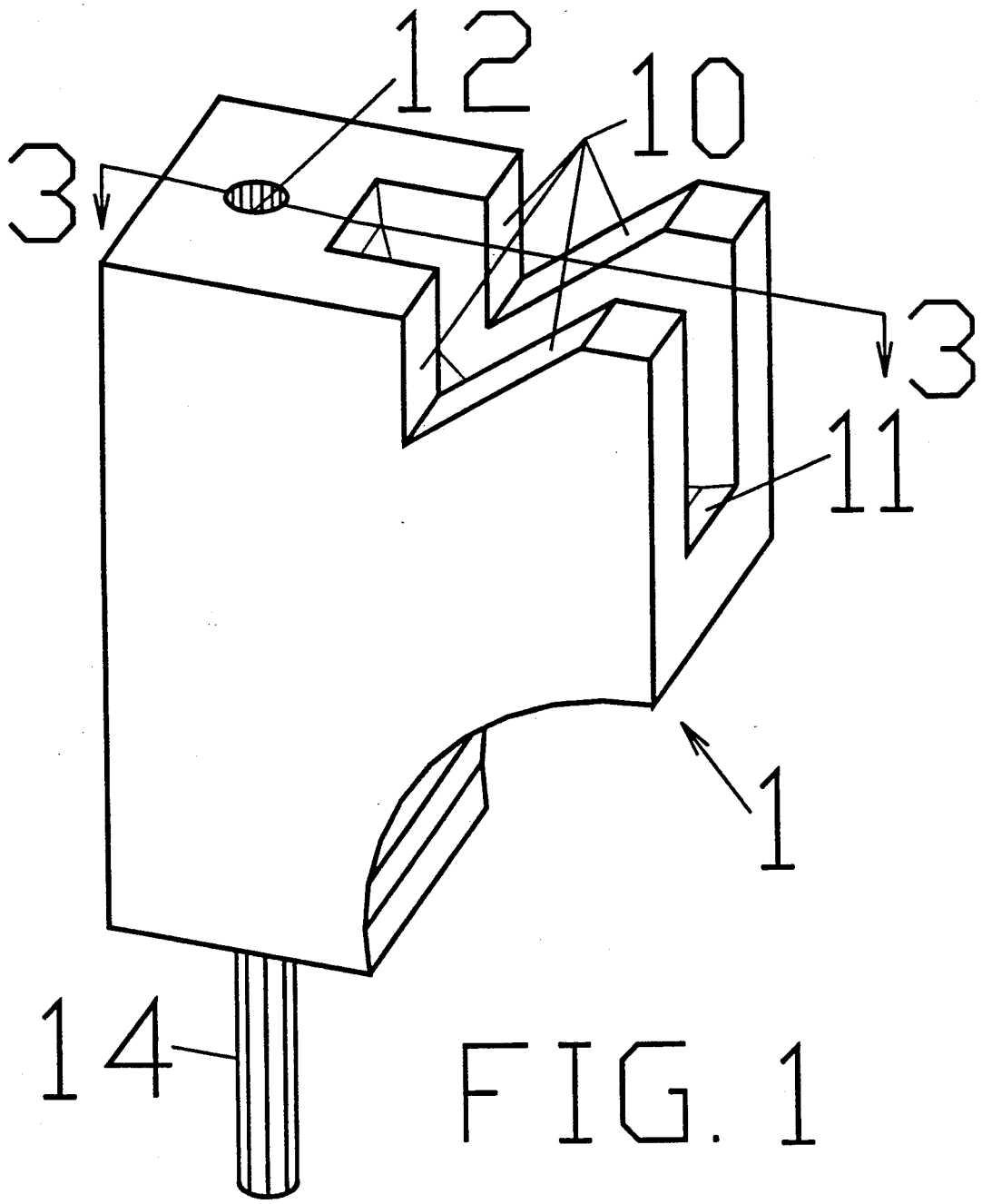
FIG. 1 is a perspective view of the preferred embodiment of the bow socket.
Figure 3:
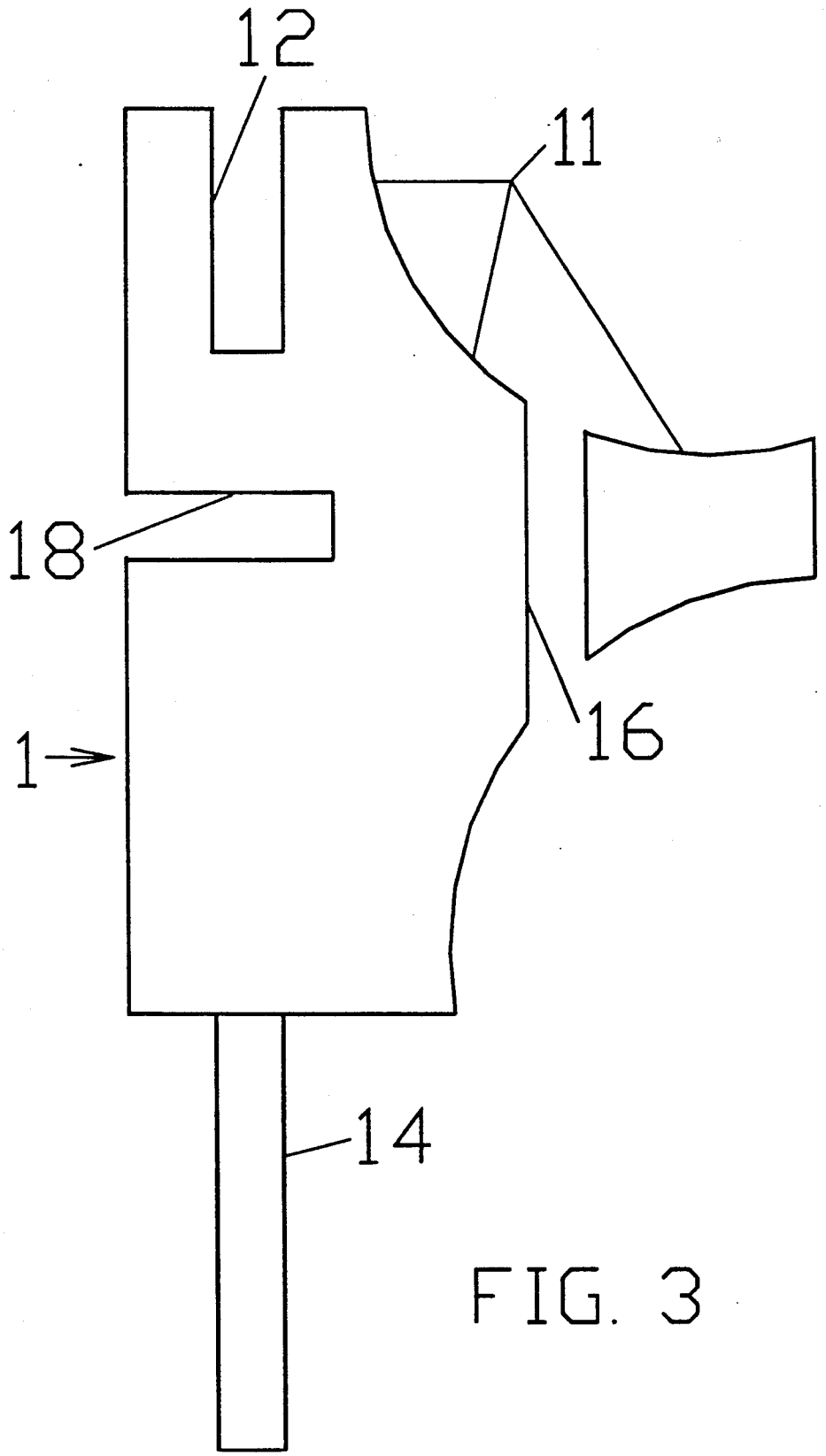
FIG. 3 is a thin, vertical cross section through the middle of the bow socket.

Bow socket 1 is illustrated in more detail on FIG. 1, and FIG. 3. The sketch of FIG. 6 shows the engagement of a compound bow 8 with the bow socket 1. In the preferred embodiment, bow socket 1 is constructed from a hardwood block that is about 104 by 80 by 48 mm. It will be apparent to one skilled in the art that any suitable material, such as metal or plastic, may also be used to construct bow socket 1. Triangular cut 10 and arc cut 11 are such that the lower portion of bow-limb 82 is supported by triangular cut 10 while the bow's end pulley 80 is within arc cut 11. Triangular cut 10 is contained in the top of bow socket 1, and is such that lower portions of bow-limbs are supported by it, in the preferred embodiment, triangular cut 10 has a uniform vertical cross section in the form of a right triangle, a depth (vertical distance) of about 20 mm, and a horizontal opening of about 25 mm. The shape of triangular cut 10 and the force of gravity limit downward, as well as horizontal (especially towards the bowstring), motion of compound bow 8. It will be apparent to one skilled in the art that cuts other than that of the preferred embodiment will serve the same function as triangular cut 10. Arc cut 11 is a cavity within triangular cut 10 such that end pulleys or end accentric cams and bowstring 84 are able to rest within arc cut 11. In the preferred embodiment, arc cut 11 has a width of about 20 mm and an essentially circular radius of about 40 mm. It has been found, for presently available compound bows, that the outside circumference of an end pulley or end eccentric cam will rest within arc cut 11 and will not touch bow socket 1. Horizontal motion of the held compound bow 8 is limited by end pulley 80 touching a side wall of arc cut 11. It will be apparent to one skilled in the art that cuts other than that of the preferred embodiment will serve the same function as arc cut 11.

The present invention encompasses equivalents for the combination of triangular cut 10 and arc cut 11 that furnish an open toped recess of suitable shape to receive the end portion of a bow-limb of a conventional bow, recurve bow, or (as shown on FIG. 6) a compound bow such that the received end portion is only completely free to move in an essentially upward direction, and such that the associated bowstring is able to engage string holder 2 or an equivalent of string holder 2. Such equivalent of triangular cut 10 and arc cut 11 may be padded or coated with soft or elastic material, but satisfactory performance is achieved with bare surfaces and a fairly loose receiving of the end portion of a bow-limb.

The top of bow socket 1 further contains bearing 12, consisting, in the preferred embodiment, of a cylindrical recess adapted to receive cylinder 24 of string holder 2. In the preferred embodiment, the primary utility of the combination of bearing 12 and cylinder 24 lies in their facilitating the decoupling of bow socket 1 from string holder 2 so that the resulting two parts may be easily transported. Secondarily, it has been found desirable for string holder 2 to be able to pivot away from bowstring 84 when compound bow 8 is withdrawn vertically from bow socket 1. However, satisfactory performance of the invention occurs when string holder 2 is not able to pivot either because of excessive friction between cylinder 24 and bearing 12 or because cylinder 24 and bearing 12 have been deliberately fixed.

Bow socket 1 also has supporting spike 14. In the preferred embodiment, supporting spike 14 consists of a metal rod of about 9 mm in diameter emanating from the bottom of bow socket 1 by about 270 mm, and adapted for engaging the earth so as to support bow socket 1, string holder 2, and compound bow 8. (In order to give more clarity in the figures, supporting spike 14 is not shown to scale.) While the preferred embodiment uses one supporting spike 14 (as the use of one spike has been found sufficient when the invention is used with the soils so far encountered), it is within the compass of the invention to use a plurality of supporting spikes so as better to resist the overturning moment and torque of the assembly when the assembly is used over sand or other such loose soil. It is also within the compass of the invention to use a conventional fastener, in lieu of or in addition to supporting spike 14, adapted to attaching bow socket 1 to a tree stand or other structure.

Figure 7:
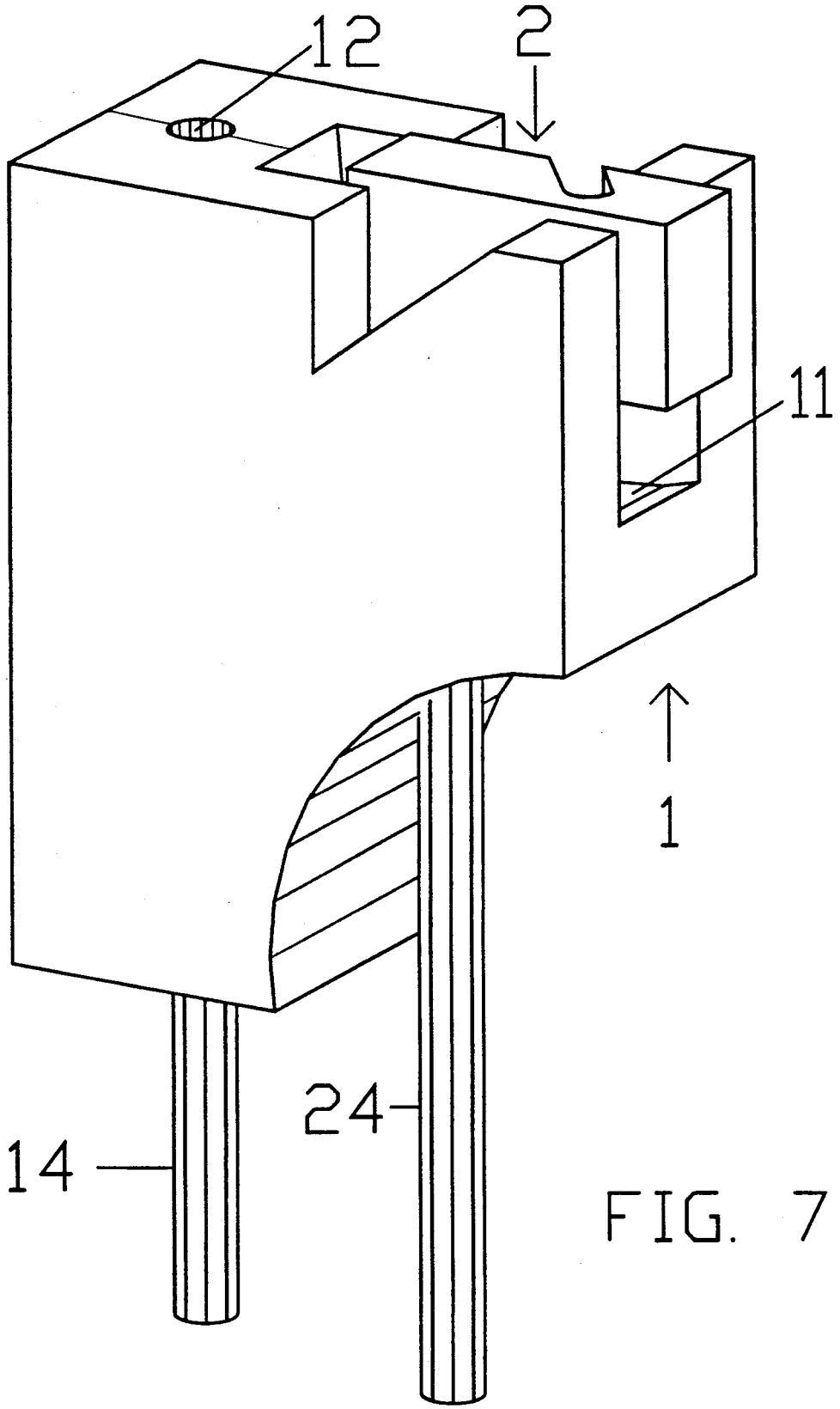
FIG. 7 is a perspective view of the string holder stowed within the bow socket.

Bow socket 1 further contains two specialized holes. Stowing hole 16 in the preferred embodiment, is placed vertically within arc cut 11 and positioned so that string holder 2 may be stowed within bow socket 1 by sliding cylinder 24 through stowing hole 16. FIG. 7 shows how the two parts may be nested together to effect a compact unit that is easier to carry than two separate units.

Threaded hole 18, in the preferred embodiment, is placed on a face of bow socket 1 and provided with the proper threads so as to be able to retain a string bobbin tracking device. An appropriate string bobbin tracking device is disclosed in U.S. Pat. No. 4,557,243, incorporated herein by reference.

Figure 2:
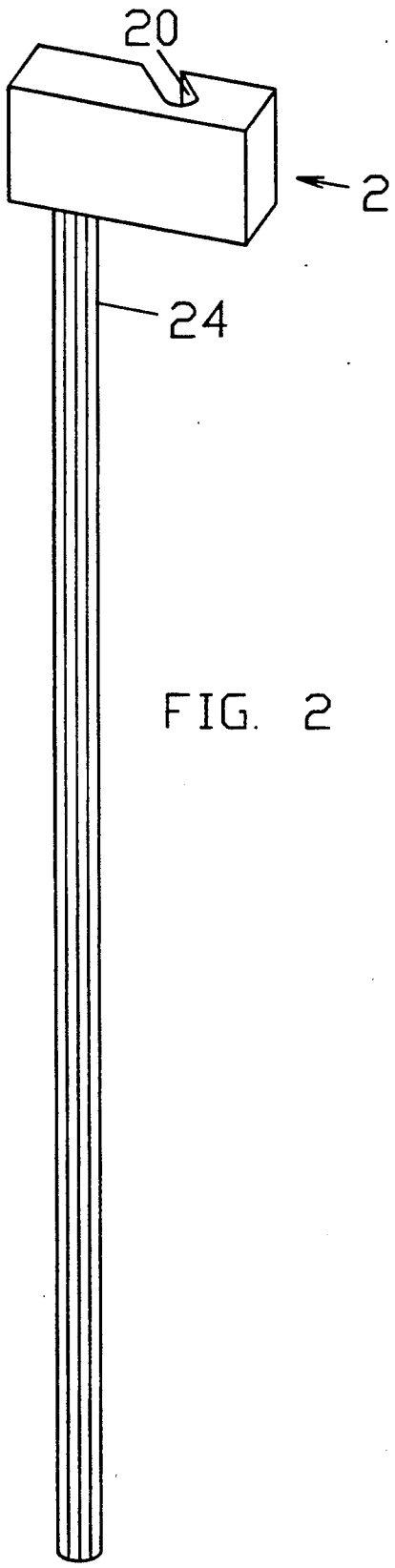
FIG. 2 is a perspective view of the preferred embodiment of the string holder.
Figure 4:
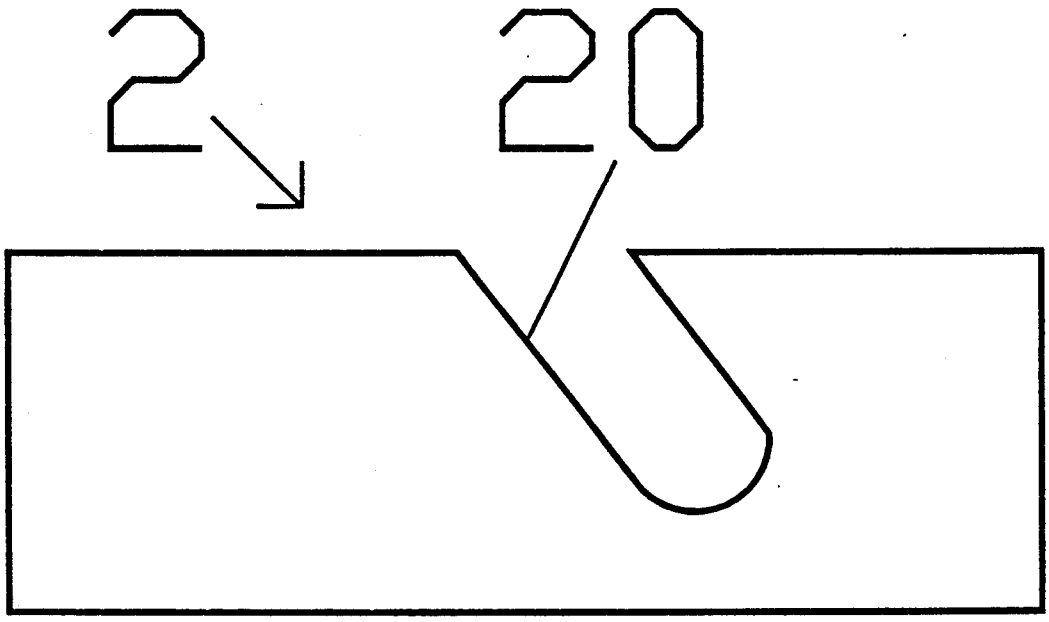
FIG. 4 is a top view of the string holder.

String holder 2 is illustrated in more detail on FIG. 2, and FIG. 4. The sketch of FIG. 6 shows the engagement of a compound bow 8 with the string holder 2. In the preferred embodiment, the body of string holder 2 is constructed from hardwood and is approximately 25 mm high. It will be apparent to one skilled in the art that other materials, such as metal or plastic, could be used to construct the body of string holder 2. String holder 2 serves to support compound bow 8 in an essentially vertical position by detachably holding bowstring 84 some distance above bow socket 1. In the preferred embodiment, string holder 2 further comprises cylinder 24 emanating from the bottom of string holder 2 and pivotly engaging bearing 12 on bow socket 1, and string holding groove 20 that is adapted detachably to hold bowstring 84. Cylinder 24 is a rod, about 9 mm in diameter, constructed of metal, and is of such a length as to make the distance between the top of bow socket 1 and the bottom of string holder 2 about 260 mm when cylinder 24 is fully engaged with bearing 12. While the aforementioned distance is about 260 mm in the preferred embodiment (as that length has been found to be satisfactory for use with the range of bows encountered), a different distance might be appropriate for use with especially tall or short bows. Whatever type or size bow is used, string holding groove 20 is to be caused to be positioned so that the held bowstring is essentially vertical when the bow-end is confined within bow socket 1. String holding groove 20, most clearly seen on FIG. 4, is a forward and sideward opening slot (i.e. the opening points away from the held bow-limb) that is smooth and wide enough easily to receive bowstring 84. The inclination of string holding groove 20, and its placement with respect to the axis of cylinder 24, is such that the gravitationally induced moment exerted on the entire bow (with bow socket 1 effectively a fulcrum) will pull bowstring 84 firmly into string holding groove 20. It will be apparent to one skilled in the art that various grooves, channels, notches, slots, hooks, and other devices may be used to serve the same function string holding groove 20.

In the preferred embodiment, bow socket 1 and string holder 2 operate cooperatively to hold a compound bow 8 in an essentially vertical portion. Thus bearing 12, triangular cut 10, and string holding groove 20 are placed relative to each other such that bowstring 84 will be essentially vertical when a compound bow 8 is held as indicated by the sketch of FIG. 6. The present invention encompasses a holder for any bow where the holder comprises: an upwardly open socket shaped to receive and confine the bow's bow-end; a hook (or equivalent) shaped to receive and confine the bowstring; and some means for positioning the hook above the socket (even if the then held bow departs somewhat from being essentially vertical). It will be apparent to one skilled in the art that means other than the use of cylinder 24 and bearing 12 may be used to position a bowstring holder above a bow-end socket.

While the preferred embodiment uses one string holder, as it has been found that one string holder gives satisfactory performance, multiple string holders positioned above a bow socket are encompassed by the present invention. Such multiple string holders might be desirable if especially heavy bows are used.

An additional provision is present on the preferred embodiment to facilitate the invention's use with a string bobbin tracking device. In use, a string bobbin tracking device is screwed into the riser, which is between the upper and lower bow-limbs, and an arrow is attached to one end of the bobbin's string. After discharge of such an arrow, the bobbin is unscrewed from the riser and screwed into threaded hole 18. The archer is thus free to follow the bobbin's string without danger of the remaining string on the bobbin becoming fouled and with the knowledge that the bobbin's string may be followed back to the bow socket 1. Thus, the archer is less likely to become lost, the bow pod and associated hardware are likely to be recovered and not left in the woods, and (of paramount importance) the perceived need for the unacceptable practice of screwing hooks into trees, to serve as receptacles, is greatly attenuated. It has been found, when using a tree stand, that the ability to screw the bobbin into threaded hole 18 has a safety advantage as the tendency of the archer to become entangled in the bobbin's string while climbing down from the tree stand is eliminated.

It is expected that the archer has transported the two part of the invention in the stowed attitude (as shown on FIG. 7) to the site where the invention is to be used. Upon reaching the site, the archer separates the two parts from the stowed attitude, and inserts cylinder 24 into bearing 12. The archer pushes supporting spike 14 into the ground or otherwise attaches bow socket 1 in a vertical attitude. The archer's bow is placed end first into triangular cut 10 with the bow's end pulley or eccentric cam (if any) between the walls of arc cut 11, and with the bow's bowstring facing string holder 2. The archer's bow is then tilted forward (toward the bowstring) to place the bowstring within string holding groove 20. The bow is now detachably held essentially vertically and an arrow may be nocked, ready for use, with the arrow essentially horizontal. When it is time to take up the bow, the archer grasps the bow-limb where it is normally grasped below the nocked arrow and lifts the bow from the invention. The customary act of grasping while drawing the arrow also frees the bow from the invention and does so with negligible bow movement being perceivable by any game in front of the bow. If the archer is using a string bobbin tracking device, after firing an arrow, he or she may detach the string bobbin tracking device from the riser between the bow-limbs and screw the string bobbin tracking device into threaded hole 18. Thus, the chance of a snarl is practically eliminated (increasing the chances of being able to follow the string to the game), and the archer is likely to be able to return to the bow pod.

It has been found that the preferred embodiment may be mounted to a tree stand by drilling a vertical hole of about 10 mm in diameter in the tree stand and inserting supporting spike 14 therein. It has also been found that when one causes a significant side displacement of the midpoint of a bow held by the preferred embodiment and then releases the bow, the bow is pulled back to its original position by the additional tension induced into the bowstring by the displacement.

A developed and thoroughly field tested preferred embodiment of the invention has been described in detail. The description of the preferred embodiment is illustrative and not restrictive. The drawings show that the preferred embodiment contains an ornamental design in the form of a curved void on the lower portion of bow socket 1, adjacent to supporting spike 14.

I claim:

1. A holder of an archery bow, utilizing a compound bow having a bow-end, an end-pulley, and a bowstring, comprising:

a block having a top, bottom, front side, back side, left side, and right side;

a socket of uniform cross section, upwardly open, adapted to confine the bow-end, placed in said top of said block, and extending from said front side to said back side;

a cavity shaped to receive loosely the end-pulley, placed in said top and said right side of said block between said front side and said back side;

a hook having a gap wider than the bowstring, capable of retaining the bowstring, and facing away from the right side; and positioning means, communicating with said block and said hook, for positioning said hook above said socket.

2. A holder of an archery bow, utilizing a compound bow having a bow-end, an end-pulley, and a bowstring, comprising:

a block having a top, bottom, front side, back side, left side, right side, and a threaded receptacle cut into said left side;

a socket of uniform cross section, upwardly open, adapted to confine the bow-end, placed in said top of said block, and extending from said front side to said back side;

a cavity, shaped to receive loosely the end-pulley, placed in said top and said right side of said block between said front side and said back side;

a hook having a gap wider than the bowstring and capable of retaining the bowstirng; and positioning means, communicating with said block and said hook, for positioning said hook above said socket.

3. A holder of an archery bow, utilizing a compound bow having a bow-end, an end-pulley, and a bowstring, comprising:

a block having a top, bottom, front side, back side, left side, and right side;

a socket of uniform cross section, upwardly open, adapted to confine the bow-end, placed in said top of said block, and extending from said front side to said back side;

a cavity, shaped to receive loosely the end-pulley, placed in said top and said right side of said block between said front side and said back side;

a hook having a gap wider than the bowstring and capable of retaining the bowstring; and positioning means, communicating with said block and said hook, for positioning said hook above said socket, said positioning means consisting of a rod with an upper end affixed to said hook and a lower end detachably retained within said block.

4. A holder as recited in claim 3, further comprising a vertical recess placed in said block, extending from said top to said bottom, and shaped to receive loosely said rod.

5. A holder of an archery bow, utilizing a compound bow having a bow-end, an end-pulley, and a bowstring, comprising:

an upwardly open socket receiving the bow-end and to confine the bow-end from horizontal movement toward the bowstring;

a cavity, within said socket, receiving loosely the end-pulley when the bow-end is received by said socket; and a string holding means, positioned above said socket, receiving and confining the bowstring, with the bowstring received in said means.

6. A holder as recited in claim 5, wherein said socket has a vertical cross section that is triangular.

7. A holder as recited in claim 6, wherein said triangular cross section is essentially that of a right triangle.

8. A holder a recited in claim 5, wherein said cavity has a vertical cross section that is essentially part of a circle.

9. A holder as recited in claim 5, wherein said string holding means is selected from the group consisting of grooves, channels, notches, slots, and hooks.

10. A holder as recited in claim 5, further comprising one or more spikes protruding below said socket.

11. A holder as an archery bow, utilizing a bow having a bow-end and a bowstring, comprising:

an upwardly open socket receiving and confining the bow-end;

a hook shaped to receive and confine the bowstring, with the bowstring received in said hook; and positioning means, communicating with said socket and said hook, for placing said hook above said socket such that, when the bow-end is confined within said socket and the bowstring is confined within said hook, the bowstring is essentially vertical.

12. A holder as recited in claim 11, wherein said socket has a vertical cross section that is triangular.

13. A holder as recited in claim 12, wherein said triangular cross section is essentially that of a right triangle.

14. A holder as recited in claim 11, wherein said positioning means is a rod with an upper end attached to said hook and a lower end attached to said socket.

15. A holder as recited in claim 11, further comprising one or more spikes protruding below said socket.

* * * * *